United States Patent [19]

Kawarabashi et al.

[11] Patent Number: 4,570,865

[45] Date of Patent: Feb. 18, 1986

[54] COP SUPPLYING DEVICE

[75] Inventors: Tsukasa Kawarabashi, Kyoto; Shinji Takahashi, Joyo, both of Japan

[73] Assignee: Murata Kikai Kabushiki Kaisha, Japan

[21] Appl. No.: 541,095

[22] Filed: Oct. 12, 1983

[30] Foreign Application Priority Data

Oct. 13, 1982 [JP] Japan ..... 57-155425[U]

[51] Int. Cl.[4] ..... B65H 54/20; B65H 67/06

[52] U.S. Cl. ..... 242/35.5 A; 209/927; 242/36

[58] Field of Search ..... 242/35.5 A, 35.5 R, 242/35.6 R, 36; 57/274, 276; 198/645, 651; 209/927; 221/171, 9, 10

[56] References Cited

U.S. PATENT DOCUMENTS 3,224,694 12/1965 Oishi ..... 242/35.5 R
3,358,940 12/1967 Beckwith, Jr. et al. ..... 242/35.5 A
3,381,908 5/1968 Igushi et al. ..... 242/35.5 R
3,389,866 6/1968 Mullers ..... 242/35.5 R
3,480,216 11/1969 Iannucci et al. ..... 242/35.5 R X
3,966,141 6/1976 Nishiyama et al. ..... 242/35.5 A
3,991,894 11/1976 Matsui et al. ..... 242/35.5 R X
4,010,907 3/1977 Nishiyama et al. ..... 242/35.5 A
4,063,635 12/1977 Heckel ..... 242/35.5 A X

*Primary Examiner*—Stanley N. Gilreath
*Attorney, Agent, or Firm*—Spensley Horn Jubas & Lubitz

[57] ABSTRACT

A cop supplying device for feeding a cop to a carrier member which is adapted to convey the cop to an automatic winder. The cop supplying device comprises a storing box for storing a plurality of cops, a cop transporting device for feeding the cops to the cop box, a device for detecting and ejecting wrong cops interposed between the cop box and the transporting device, and a releasing device for releasing the cops from the cop box and fitting the cop on the carrier member.

7 Claims, 6 Drawing Figures

COP SUPPLYING DEVICE

BACKGROUND OF THE INVENTION

The present invention relates to a cop supplying device for automatically feeding a cop to a cop carrier member when the cop doffed from a fine spinning frame is to be supplied to an automatic winder.

As a system for automatically feeding a cop to the winding unit of an automatic winder, there have been proposed a variety of feeding methods such as a method by which a number of cops are stored at an end portion of the frame of an automatic winder and fed from said storing portion through a conveyor to a cop magazine mounted on each winding unit, a method by which a travelling truck is loaded with a cop at the aforementioned cop storing portion and run along the winding unit to feed the cop to a magazine, or a method by which cops are conveyed while standing upright on disc-shaped members having pegs independently of one another without any provision of the aforementioned magazine so that they are fed in their upright positions on said disc-shaped carrier members to the winding unit. However, any of the methods is not freed from the step of feeding the cop from the cop supplying device, which is disposed at the end portion of the winder, to a belt conveyor, travelling truck or the disc-shaped carrier member. At the aforementioned step, according to the prior art, all the cops are conveyed and fed to the winder without being selected whether the cop is properly or improperly wound. As a result, the wrong cop, which is abnormally taken up, for example, the cop, which has only its one end portion of a core wound with a yarn layer, cannot be subjected to a starting yarn end seeking and removing operation for an automatic knotting purpose, even if it is fed to the winder, so that it is not unwound but is ejected.

The conveyance of abnormal cops together with normal cops is not only useless but also causes reduction in the working efficiency of the winder.

SUMMARY OF THE INVENTION

It is an object of the present invention to detect in advance an abnormal cop in a cop supplying device and to eject the same from the cop feeding passage to a winder. Thus, all the cops to be fed to the winder may be limited to those which are wound in a normal manner.

According to the present invention, there is provided a cop supplying device for feeding a cop to a carrier member which is adapted to convey the cop to an automatic winder, comprising: a cop box for storing a plurality of cops; a releasing device for releasing the cops from the box; and a transferring device for transferring the cops to the cop box, wherein there is interposed between the cop transferring device and the cop box a device for detecting and ejecting an abnormal cop.

As a result, the storage passage of the cop box can be stored with only the cops having a predetermined quantity of yarn so that all the cops to be fed from said cop supplying device to the carrier member can be normal ones. As a result, no abnormal cop is fed to the automatic winder so that the reduction in the working effeciency of the winder, which might otherwise be caused by feeding the winder with the cops unable to be knotted, can be prevented. At the same time, since the abnormal cops can be ejected before they are stored in the cop box, the cops need not be selected, when they are fed from the cop supplying device to the carrier member, so that the cop feeding operation to the carrier member can be conducted smoothly to increase the feeding rate of the cops to the winder and to shorten the cop awaiting period of the winder.

DETAILED DESCRIPTION OF THE INVENTION

The present device will be described in the following in connection with the embodiment thereof with reference to the accompanying drawings.

Figure 1:
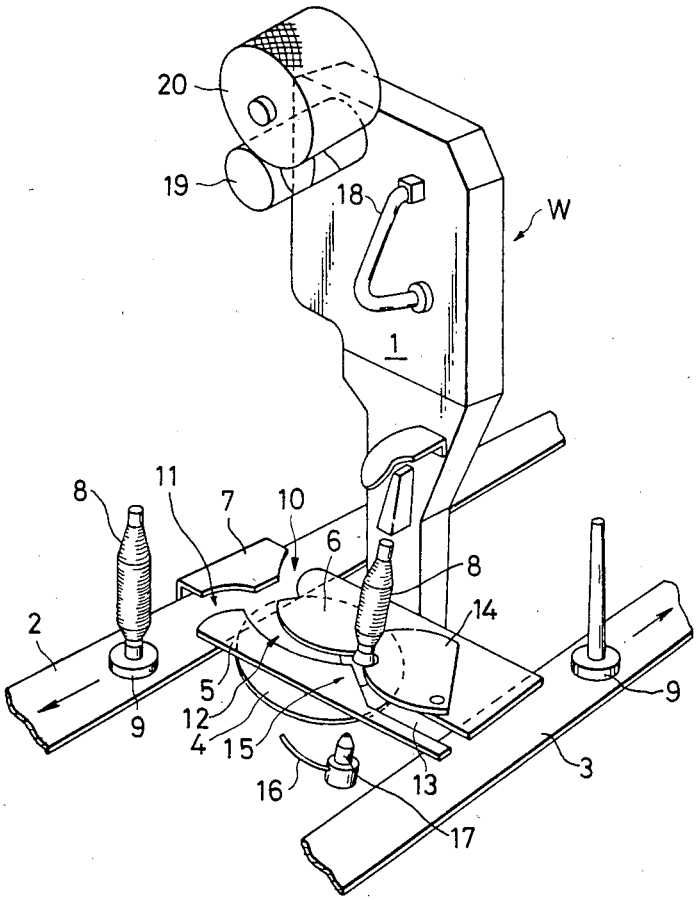
FIG. 1 is a perspective view showing the schematic construction of one example of the winder and the cop carrier member.

FIG. 1 shows one example of the cop supplying system of an automatic winder, in which a winding unit 1 is interposed between a cop feeding passage 2 and an empty bobbin ejecting passage 3 both being arranged therealong so that a cop is supplied from the feeding passage 2 by the actions of a rotary disc 4 and guide plates 5, 6 and 7.

The aforementioned cops 8 are mounted independently one by one on disc-shaped carrier members 9 (which will be called "trays") having pegs protruded therefrom at the center of the member so that they are conveyed integrally with the trays until they are fed to the winding unit and cops are fitted on the empty trays at a later-described cop supplying device.

In the aforementioned winding unit, the rotary disc 4 is slightly sloped that its side at the cop feeding passage 2 is higher than its side at the ejecting passage 3. The guide plates 5 and 6 are fixed to the frame of the unit such that they are arranged above and at a predetermined spacing from the upper face of the rotary disc 4. The guide plate 6 is formed with a cop inlet port 10 between itself and the guide plate 7, whereas the guide plate 5 is formed with a cop outlet port 11 between itself and the guide plate 7. Moreover, a cop reserve line 12 and an empty bobbin eject line 13 are formed between those guide plates 5 and 6.

Reference numeral 14 indicates a swinging lever for ejecting the empty bobbin at the yarn running position of the winding unit.

Below the rotary disc of the yarn running position 15, there is disposed an air injection nozzle 17 which is connected to a conduit 16 leading to a not-shown compressed air supply source.

The air jetted from said nozzle 17 flows through the not-shown slit of the rotary disc into the inside of the peg of the tray and is injected into the bore of the cop from a hole, which is formed in the leading end of the peg, so that the yarn end suspended in advance into the bore of the bobbin is blown upward and sucked and held by a relay pipe 18 standing by thereabove until it is guided to a knotting device.

The winding unit 1 is equipped with the aforementioned relay pipe, a balloon breaker, a suction mouth for guiding the yarn end at the package side to the knotting device, a knotting device or a slub catcher, and a tensioning device.

As a result, the yarn drawn out from the cop fitted on the tray 9 shown in FIG. 1 is taken up upon a package 20 which is rotated by a traverse drum 19.

Incidentally, the cop to be conveyed by the aforementioned cop feeding passage 2 is automatically taken up by the run of the conveyor 2 from the inlet port 10 of the unit until it is conveyed to the reserve groove 12. When a predetermined number of cops are stored, the subsequent cop on the feeding passage 2 is blocked from entering the reserve groove 12 to leave the outlet port 11 until it moves to the subsequent winding unit.

As a result, feed of the predetermined number of cops to each winding unit is conducted merely by running the conveyor 2.

The cop supplying device, which is to be applied to the cop feeding system thus far described to feed the cops to the aforementioned tray, will be described with reference to FIGS. 2 to 5.

Figure 2:
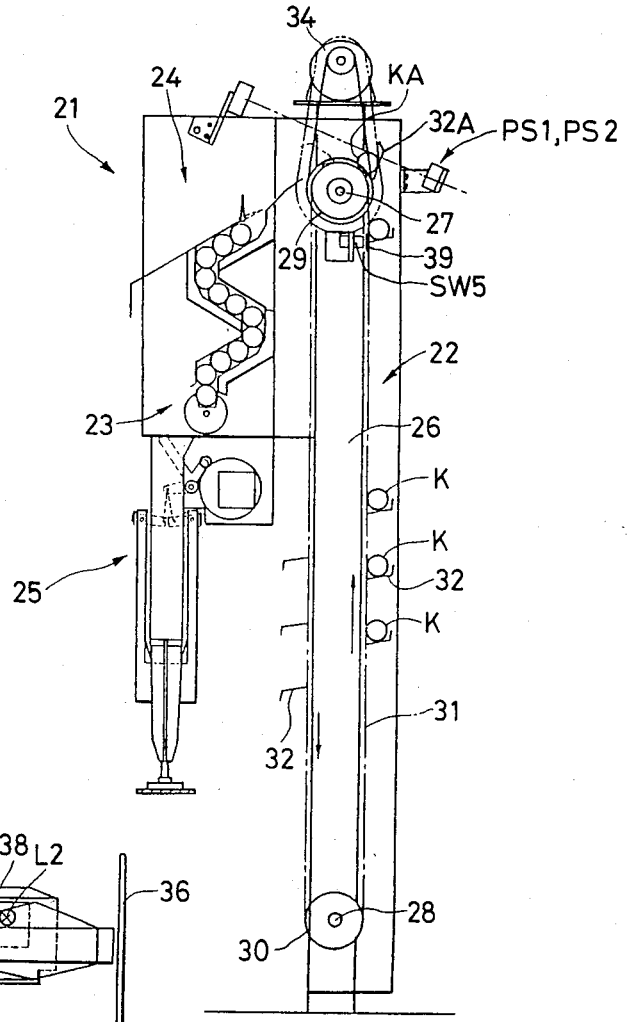
FIG. 2 is a side elevation showing the schematic construction of the embodiment of the present cop supplying device.
Figure 6:
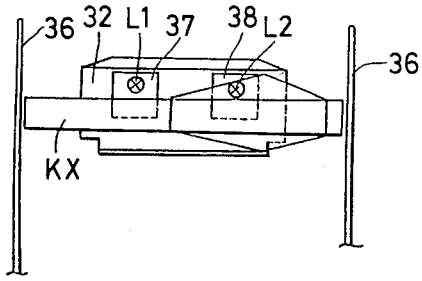
FIG. 6 is an explanatory view showing one example of the method for detecting abnormal cops.

FIG. 2 shows the overall construction of the cop supplying device.

Specifically, a cop supplying device 21 is constructed of: conveying means such as a lattice 22 which is adapted to raise such cops separately one by one as they are doffed from a fine spinning frame and conveyed by a not-shown truck or conveyor; a cop box 24 equipped with a releasing device 23, which is adapted to stock the cops dropping from the upper end of said lattice 22 and to release the cops one by one; and a guide device 25 for fitting the cops released from said box 24 onto the trays waiting therebelow.

Figure 5:
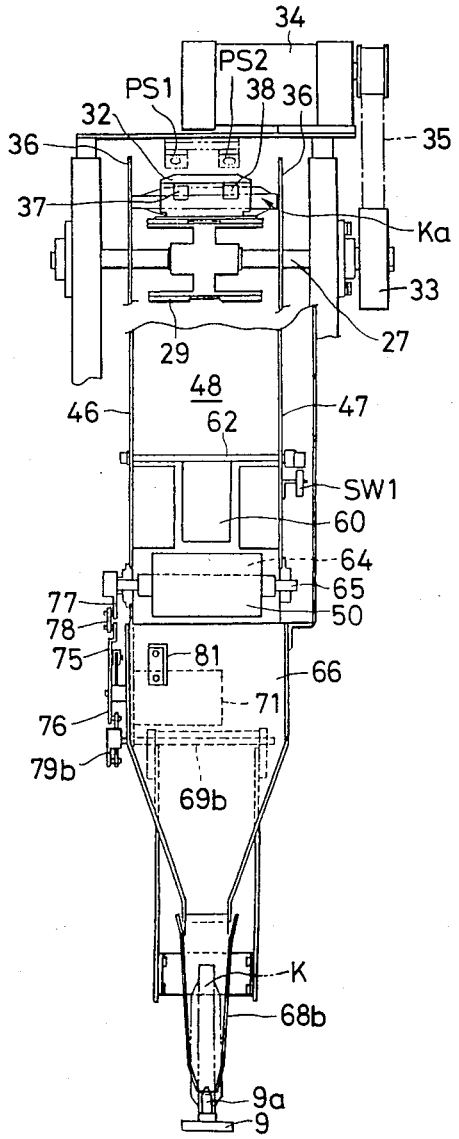
FIG. 5 is a front elevation of the same.

The aforementioned lattice 22 is constructed by fixing cop carrying plates 32 at a predetermined pitch to a chain 31 which is made to run between sprockets 29 and 30 supported rotatably at the upper and lower portions of a post 26, as indicated at 27 and 28. To the end portion of the shaft 27 fixed in the upper sprocket 29, as shown in FIG. 5, there is secured a timing pulley 33, to which power is transmitted through a motor 34 and a timing belt 35. At both the side portions of the chain 31, moreover, there are disposed guide plates 36 and 36 which are provided on at least the cop delivery side of the chain conveyor so as to regulate the movement of the cops in the axial direction of the cops.

The aforementioned respective cop carrying plates 32 are provided at two positions, i.e., at two predetermined spacings in the axial direction of the cop, with optical inspection apertures 37 and 38 for detecting the presence of the yarn layer of the cop placed thereon.

Optical transmission type photo sensors PS1 and PS2 for detecting the presence of the aforementioned yarn layer are provided to discriminate at the uppermost position, as shown in FIG. 2, i.e., the state of the cop KA immediately before the cop is drop into the cop box.

Below the position 32A and a spacing equal to the pitch of the cop carrying plates, there is disposed a contact switch SW5 for sensing an iron member 39 secured to each of the cop carrying plates 32.

Specifically, when the contact switch Sw5 is turned on, i.e., when at least one of the optical sensors PS1 and PS2 detects the optical transmission, the yarn layer of the cop is judged to be so abnormal as to have no predetermined quantity of yarn or an abnormally wound form so that the cop is ejected to another passage by the action of a later-described eject device R.

Figure 3:
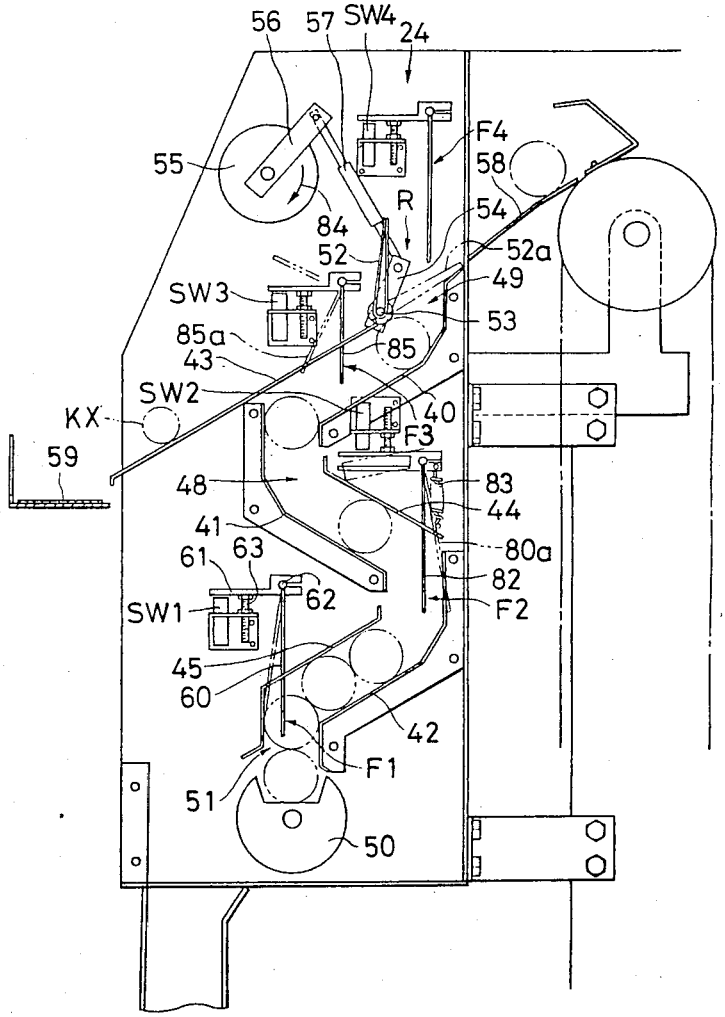
FIG. 3 is a side elevation showing the cop box of the same supplying device.

Next, the cop box for storing the cops delivered by the aforementioned lattice 22 will be described with reference to FIG. 3.

The cop box 24 is formed with a zigzagged cop storage passage 48 by guide bottom plates 40, 41 and 42, upper plates 43, 44 and 45 and side plates 46 and 47 juxtaposed at a spacing substantially equal to the cop length shown in FIG. 5. The cop box 24 has its upper end formed with an inlet opening 49 and its lower end formed with an outlet opening 51 which faces a releasing drum 50.

A switching plate 52 for opening and closing the aforementioned inlet opening 49 is borne in the opening 49, as indicated at 53. A lever 54 secured to the pin 53 and a lever 56 secured to the shaft of a rotary solenoid 55 are connected by means of a rod 57. The aforementioned switching plate 52 is enabled to swing between a solid line position and a double-dotted position 52*a*.

The upper plate 43 forms a guide face when the aforementioned switching plate 52 closes the opening 49 in a manner to merge into a guide plate 58 thereby to form a ejecting passage for abnormal cops.

Below the lower end of the aforementioned guide plate 43, there is arranged a conveying medium for ejecting abnormal cops, such as a conveyor 59. This conveyor 59 may be replaced by a box for storage purposes.

Incidentally, feelers F1, F2, F3 and F4 are disposed midway of the cop storage passage 48 of the aforementioned cop box. Each of the feelers F1, F2, F3 and F4 is associated with a corresponding switch SW1, SW2, SW3 and SW4, as illustrated in FIG. 3.

Since the respective feelers have a similar construction, the following description is directed only to the feeler F1. Both a sensing plate depending into the passage 48 and a lever 61 are borne integrally, as indicated at 62, so that the sensing plate 60 is biased in the direction of the solid line position shown in FIG. 3 by the weight of the lever 61. This lever 61 is brought close to the contact switch SW1 by the action of a stopper 63 to turn off the switch SW1.

The feeler F1 operates to stop the releasing operation when the cop storage passage 48 is cleared of cops. The feeler F2 operates to generate a cop demand signal thereby to start the lattice 22 when there is left a few cops in the passage 48.

The feeler F3 detects that the passage 48 is fully occupied with the cops fed from the lattice, and then stops the operation of the lattice.

The feeler F4 operates when the guide plate 58 is clogged with cops by some cause. More specifically, feeler F4 is used for the detecting purposes to judge the clogging, when the sensing plate is not found in the solid line position after lapse of a predetermined time period, to stop the operation of the lattice and to indicate a malfunction by turning on a red lamp or the like.

Next, the cop releasing device 23 and the guide device 25 will be described with reference to FIGS. 4 and 5. The releasing drum 50 is arranged to face the lower end opening 51 of the cop storage passage 48.

Said drum 50 is made of a cylindrical body formed with a cop receiving groove 64 and is rotationally reciprocated on a pivot pin 65 between a cop receiving position and a cop ejecting position.

A chute 66 is arranged subsequent to the cop ejecting position of the drum and is fixed to the box 24, and cop guide plates 68*a* and 68*b*, to be opened and closed at right angles with respect to the moving direction of the tray 9, are arranged subsequent to a lower end opening 67 of the chute 66 and are borne at 70*a* and 70*b* by brackets 69*a* and 69*b* fixed to the sides of the chute 66.

More specifically, the aforementioned cop guide plates 68*a* and 68*b* are formed into semi-cylindrical halves, which are made by splitting a cylindrical body, and are operative, when in their closed position shown in FIG. 5, to mount the dropping cop on a peg 9*a* of the tray 9 waiting below. In other words, the cop guide plates act to position the cops. While the tray 9 is being delivered, the guide plates 68*a* and 68*b* are held in such open position as not to obstruct the passage of the tray and the peg carrying the cop.

As a result, the cop can be fed and mounted while the tray is being placed on the cop feeding passage 2.

The aforementioned guide plates 68*a* and 68*b* and the aforementioned releasing drum 50 are made coactive With a cam plate 72 rotationally driven by a motor 71. More specifically, the cam plate 72 is forced to contact a cam lever 73 which is adapted to rock on a pivot pin 74. Levers 75 and 76 are integrated with the cam lever 73. The longer level 75 is connected through a rod 78 to a lever 77 which in turn is secured to the shaft of the drum 50, and the shorter lever 76 is connected through rods 80*a* and 80*b* to levers 79*a* and 79*b* which in turn are adapted to rock together with the cop guide plates 68*a* and 68*b*.

Figure 4:
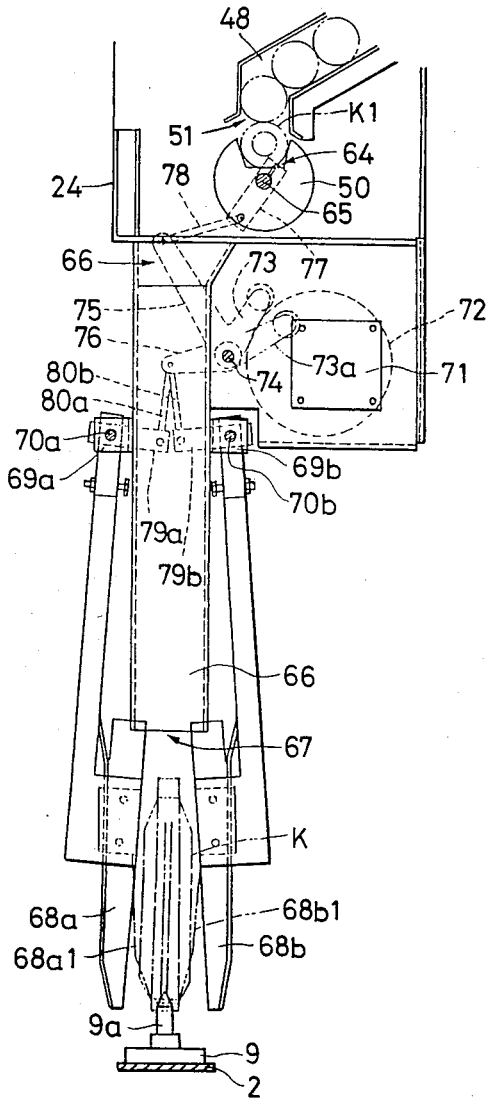
FIG. 4 is a side elevation showing the cop releasing device and the cop guide device of the same supplying device.

As a result, if the cam lever 73 is swung to its double-dotted position 73*a* by the rotation of the cam plate 72, as shown in FIG. 4, the longer and shorter levers 75 and 76 also swing clockwise on the pivot pin 74 so that the releasing drum 50 is rotated by a predetermined angle in the counterclockwise direction to eject the cop K1 out of the receiving groove 64 into the chute 66.

At the same time, the levers 79*a* and 79*b*, which are integral with the cop guide plates 68*a* and 68*b*, are pulled up by the rods 80*a* and 80*b* so that cop guide plates 68*a* and 68*b* are swung from the solid line positions to the double-dotted positions 68*a*1 and 68*b*1 to establish the cop passage.

Incidentally, reference numeral 81 appearing in FIG. 5 indicates a cop direction regulating member which is interposed between the sides of the chute 66 and which is adapted to abut against one end of the cop discharged from the drum 50 thereby to control the direction of the cop so that the cop may drop with its trailing portion Ka first. It is presumed that the cops are stored in a predetermined direction in the cop storage passage 48.

In the cop feeder thus far described, when the number of the cops left in the cop storage passage 48 is so reduced that a sensing plate 82 is brought from a double-dotted position 80*a* to the solid line position by the force of a spring 83, a contact switch SW2 is turned on to drive the lattice 22 thereby to rotationally drive the chain conveyor 31 of FIG. 2 so that the cops K placed in advance on the cop plates 32 are elevated one by one until they are fed to drop into the passage 48 from the upper end of the lattice through the guide plate 58.

At this time if at least one of the sensors PS1 and PS2 detects the optical transmission when the contact switch SW5 shown in FIG. 2 is turned on, it is judged that the cop KA at the upper end position 32A of the lattice is abnormal. By taking the logical sum of the two signals, the rotary solenoid 55 shown in FIG. 3 is energized so that the switching plate 52 is swung from the solid line position to the double-dotted position 52*a* by the swing of the lever 56 in the direction of arrow 84 thereby to plug the inlet opening 49 of the passage 48.

The aforementioned switching plate 52 is one which has a width extending over the whole area of the opening 49 and on which the abnormal cop KX having dropped from the upper end portion of the lattice rolls upon the guide plate 43 until it drops into the wrong cop ejecting passage 59.

Thus, only the normal cops are fed to the storage passage 48 of the cop box. If a sensing plate 85 comes into a displaced double-dotted position 85*a* so that a contact switch SW3 is held in its nonconductive state for a predetermined time period, it is judged that a predetermined number of cops have been fed to the inside of the passage 48, thereby to stop the operation of the lattice 22, thus finishing the feed of the cops to the cop box 24.

The feed of the cops from the aforementioned box 24 to the trays on the cop feeding passage 2 is conducted such that both the sensor for detecting that the trays reach a predetermined position on the feeding passage and the (not shown) sensor for detecting that the bobbins are not fitted on the trays send rotating instructions to the motor 71 shown in FIG. 4, whereby one cop K1 is released and fitted on the corresponding tray by one rotation of the cam 72.

Moreover, the tray having the cop fitted thereon by the aforementioned cop feeder 21 is delivered on the cop feeding passage 2 of FIG. 1 until it is fed to each winding unit 1 of an automatic winder W.

What is claimed is:

1. A device for selectively transferring cops from a yarn spinning frame to a yarn winder comprising:

discrimination means for separating each of said cops into one of a first category and a second category based upon a predefined discrimination criterion;

first transportation means for transporting said cops from said spinning frame to said discrimination means;

storage means for storing cops of said first category;

delivery means for delivering cops of said first category from said discrimination means to said storage means;

second transportation means for transporting cops of said first category from said storage means to said winder;

wherein an uninterrupted supply of cops of said first category is available in said storage means for transportation to said winder.

2. A device as in claim 1 wherein said discrimination means further comprises:

detection means for detecting the presence of cops of said second category prior to the introduction of said cops of said second category to said storage means; and gating means for directing said cops of said second category away from said storage means.

3. A device as in claim 1 further comprising:

release means for releasing cops of said first category individually from said storage means; and guide means for guiding said released cops onto said second transportation means.

4. A device as in claim 3 wherein said second transportation means comprises:

a conveyor belt;

a plurality of cop carriers resting on said conveyor belt, said cop carriers configured to receive said cops released by said release means.

5. A device as in claim 4 wherein said guide means positions said released cops on said cop carriers.

6. A device as in claim 1 wherein:

said predefined discrimination criterion is the absence of yarn abnormalties from each of said cops;

said first category includes those cops in which said yarn abnormalties are absent; and said second category includes those cops in which said yarn abnormalties are not absent.

7. A method for selectively transferring cops from a yarn spinning frame to a yarn winder comprising the steps of:

transporting said cops from said spinning frame to a discrimination station;

separating each of said cops at said discrimination station into a first category or a second category based upon a predefined discrimination criterion;

delivering cops of said first category from said discrimination station to a storage station; and transporting cops of said first category from said storage station to said winder.

* * * * *